US005919096A

United States Patent [19]

Kim

[11] Patent Number: 5,919,096

[45] Date of Patent: Jul. 6, 1999

[54] POSTURE CORRECTION AND STROKE SENSE DEVELOPMENT APPARATUS FOR GOLF RECTILINEAR PUTTING PRACTICE MECHANISM

[75] Inventor: Jae Bong Kim, Taegu-si, Rep. of Korea

[73] Assignee: Hanguk Oil Cleaner Co., Taegu-si, Rep. of Korea

[21] Appl. No.: 09/076,063

[22] Filed: May 12, 1998

[51] Int. Cl.[6] ..... A63B 69/36

[52] U.S. Cl. ..... 473/159; 473/260

[58] Field of Search ..... 473/260, 159

[56] References Cited

U.S. PATENT DOCUMENTS 3,471,155 10/1969 Donaldson ..... 473/260

3,473,810 10/1969 Nishikawa ..... 473/260 X

*Primary Examiner*—George J. Marlo

*Attorney, Agent, or Firm*—Jacobson, Price, Holman & Stern, PLLC

[57] ABSTRACT

A posture correction and stroke sense development apparatus for golf rectilinear putting practice mechanism, includes: a rectangular frame; a mat mounted on the frame, which serves the function for grassing use; a hole; and ball supply means (not shown) for providing the balls which are holed out, for putting them, wherein brackets project from a base of the frame on the opposite side of the hole, and are connected to a rectilinear guide over which a putting guide is provided to make a putter rectilinear, freely providing a rise and fall motion and a rotational motion about the rectilinear guide, and an angular motion in the forward and backward direction. The putting guide has: a rotational, motional pendulum received in the rectilinear guide, to freely rotate with respect to the shaft center of rectilinear guide; angular, motional pendulums connected to both sides of the rotational, motional pendulum, for freely performing an angular motion in the forward and backward direction of the rectilinear guide; and vertical guides with a putter club for holding the putter, and a detachment prevention bracket are longitudinally inserted into the angular, motional pendulums, to freely rise and fall.

1 Claim, 4 Drawing Sheets

POSTURE CORRECTION AND STROKE SENSE DEVELOPMENT APPARATUS FOR GOLF RECTILINEAR PUTTING PRACTICE MECHANISM

BACKGROUND OF THE INVENTION

1. Field of the Invention

The present invention relates to a posture correction and stroke sense development apparatus for golf rectilinear putting practice mechanism. More particularly, it relates to an apparatus employed for practicing correctly striking a ball by means of an optional angle adjustment into every direction in accordance with user's body size, and a rectilinear motion during a ball striking, thereby resulting in putting posture correction and sense development.

2. Discussion of Related Art

A putting is a final stroke to hole out a ball, after driving and approach. To hole out, the centers of a hole cup, the ball, and a putter should be aligned on one plane, before correctly striking the ball.

There has been used such a putting practice mechanism comprising a rectangular frame, a mat mounted on the frame, which serves the function for grassing use, and a hole.

The putting practice mechanism enables users to practice striking a ball depending on their sense only. Therefore, it is difficult to correctly practice putting the ball.

This typical mechanism suffers the disadvantages, in that an expert cannot continuously and correctly strike the ball, developing his stroke sense at the instant when the ball is struck, as well as a beginner finds it hard to retain his putting posture and sense.

SUMMARY OF THE INVENTION

Accordingly, the present invention is directed to a posture correction and stroke sense development apparatus for a golf rectilinear putting practice mechanism that substantially obviates one or more of the problems due to limitations and disadvantages of the related art.

An object of the present invention is to provide a posture correction and stroke sense development apparatus which is designed to facilitate an accurate and rectilinear putting as well as a putting posture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a posture correction and stroke sense development apparatus for golf rectilinear putting practice mechanism, for an iterative putting practice, includes a putting mechanism which makes a putter perpendicular to a ball, and aligns the putter, ball, and a hole at the time of putting.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

Figure 1:
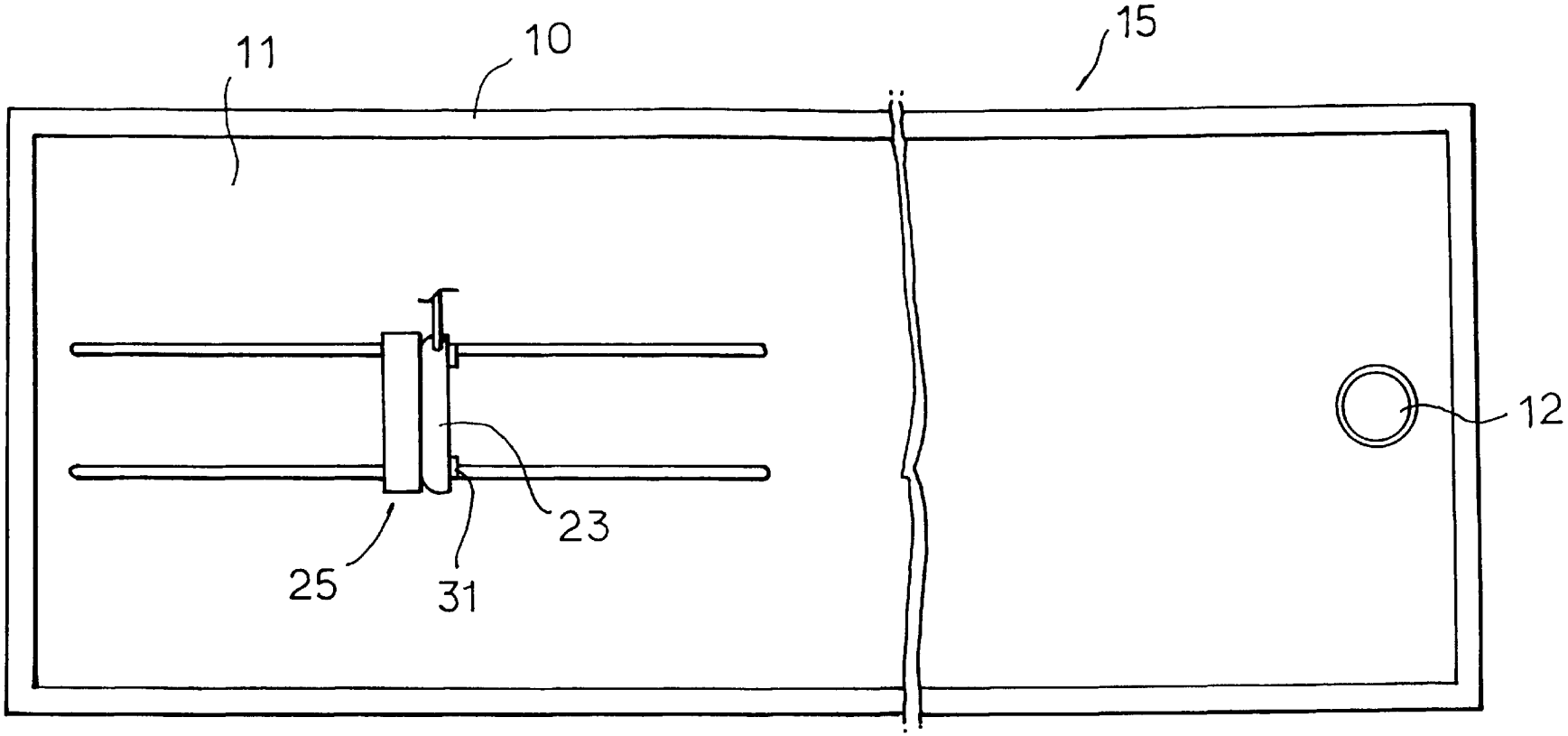
FIG. 1 is a plan view showing one embodiment of the present invention.
Figure 2:
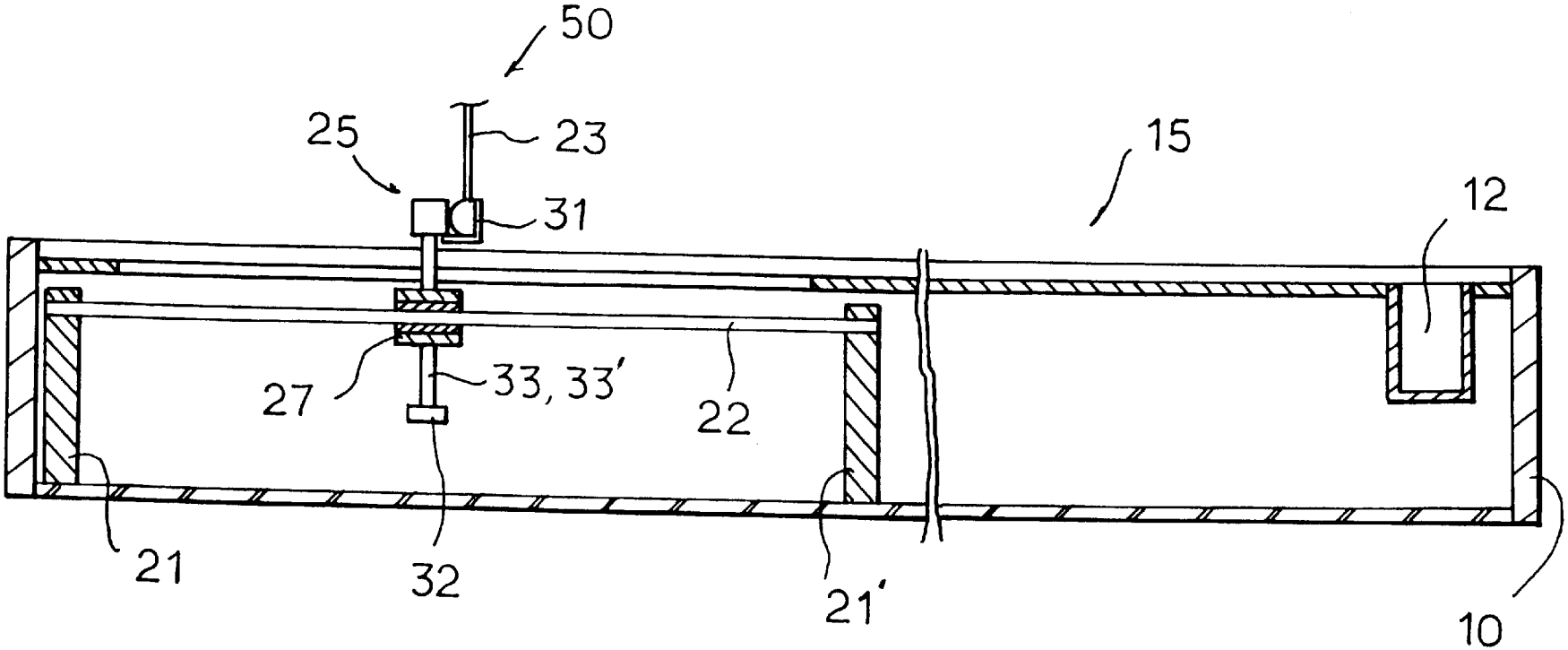
FIG. 2 is a cross-sectional view of FIG. 1.
Figure 3:
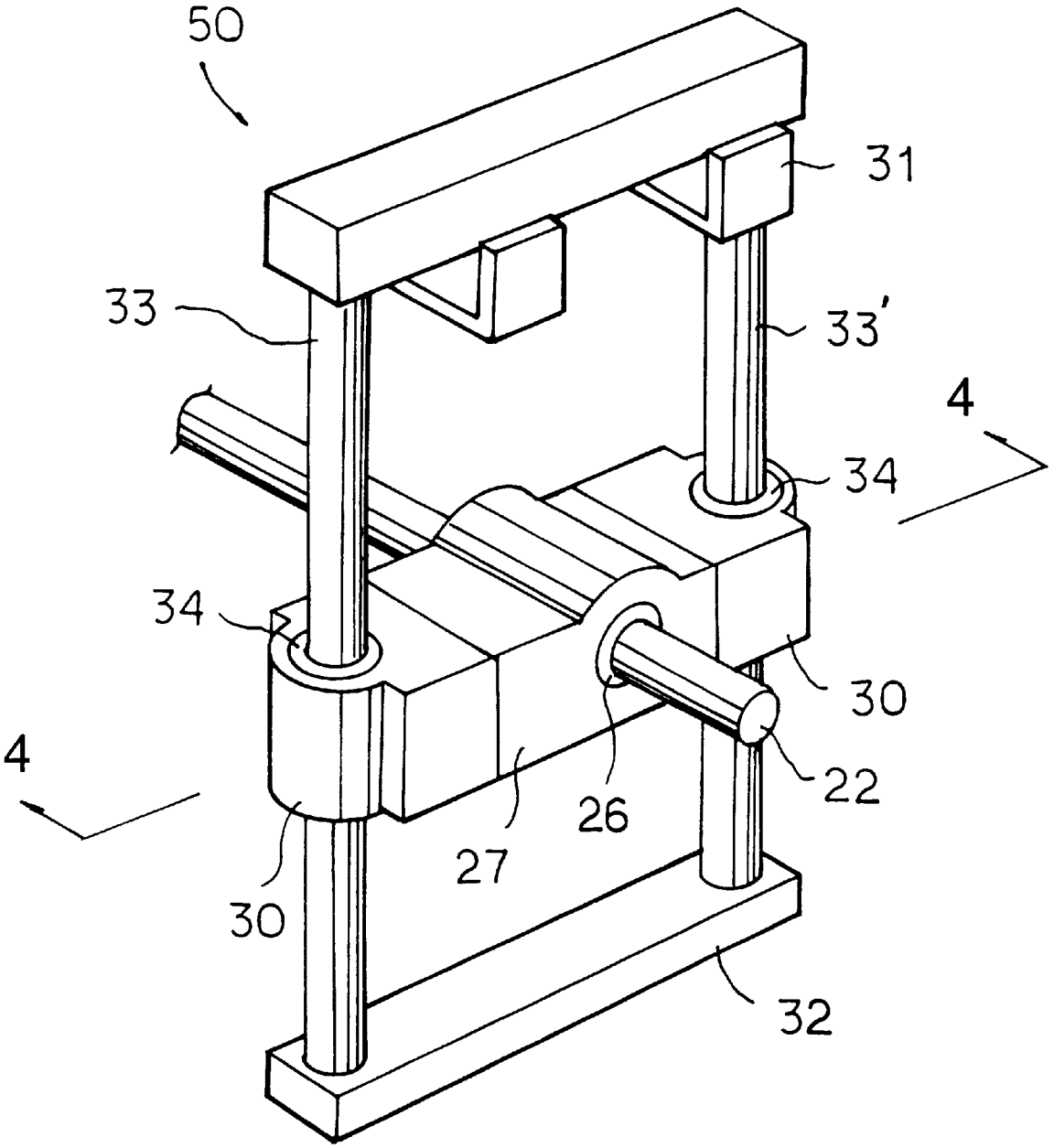
FIG. 3 is a perspective view of the main part of the present invention.
Figure 4:
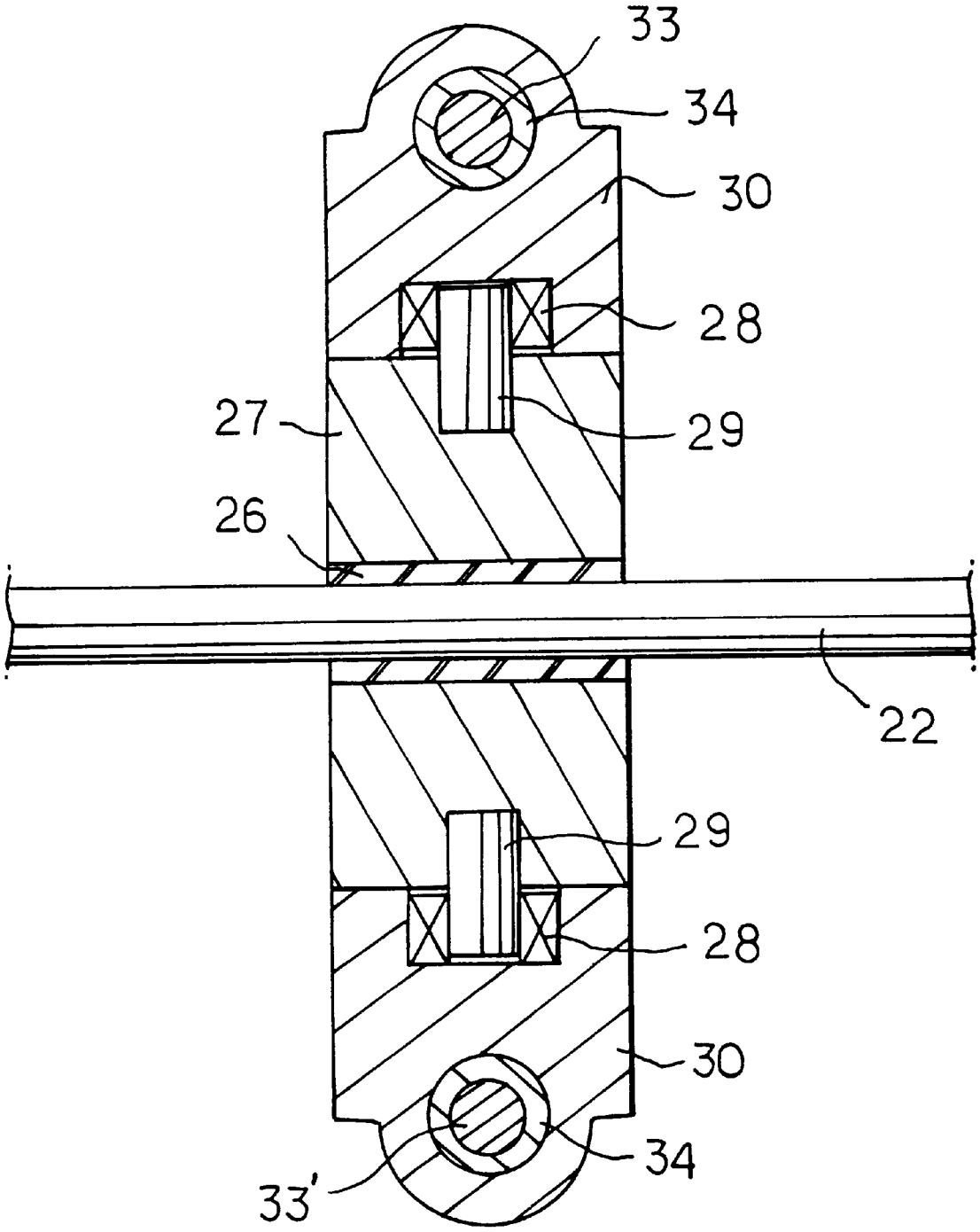
FIG. 4 is a cross-sectional view taken along the line A–A' of FIG. 2.

FIG. 1 is a plan view showing one embodiment of the present invention, FIG. 2 is a cross-sectional view of FIG. 1, FIG. 3 is a perspective view of the main part of the present invention, and FIG. 4 is a cross-sectional view taken along the line A–A' of FIG. 2.

A conventional golf rectilinear putting practice mechanism 15 includes: a rectangular frame 10; a mat 11 mounted on frame 10, which serves the function for grassing use; a hole 12; and a ball supply means (not shown) for providing the balls which are holed out, for putting them.

On the opposite side of hole 12, below a location where a user poses for putt, brackets 21 and 21' project from base 20 of frame 10, spaced apart a distance that is sufficient to putt the balls. A rectilinear guide 22 is connected between upper portions of brackets 21 and 21'.

The rectilinear guide 22 may well have an enough distance that balls are struck by a putter 23. Over the rectilinear guide 22 there is provided a putting guide 25 to make the putter 23 rectilinear, freely providing a rise and fall motion and a rotational motion with respect to rectilinear guide 22, and an angular motion in the forward and backward direction.

The putting guide 25 includes a rotational, motional pendulum 27 for allowing a rectilinear bearing 26 received in rectilinear guide 22 to freely rotate about the shaft center of rectilinear guide 22, and angular, motional pendulums 30 connected to both sides of rotational, motional pendulum 27, with a bearing 28 and shaft 29, for freely performing an angular motion in the forward and backward direction of rectilinear guide 22.

In the longitudinal direction of putting guide 25, a putter club 31 to hold the putter 23 is positioned at an upper portion of putting guide, and vertical guides 33 and 33' coupled with a detachment prevention bracket 32 are, for putter 23's rise and fall motion, inserted into a lower portion of putting guide, while a rectilinear bearing 34 is received in the putting guide.

The operation of the golf rectilinear putting practice mechanism of the present invention will now be described below. More particularly, when a user stands at his putting location and strikes a ball, in a conventional manner, with the putter 23 held in the putter club 31 of putting guide 25, the putter 23 is allowed to become rectilinear, in accordance with a change in the inclination angle or distance on the ground of the putter 23, caused by rotation of putter 23 with respect to user's shoulders, as well as a distance between the user and ball, in such a way that the user is capable of correctly striking the ball disposed in the center of putter 23.

This is because the user's putter 23 mates with the putting guide 25 so as to get rectilinear, so that the user can putt the ball, at any location, in any posture, while the center of putter 23 is in alignment with the ball and hole 12.

That is to say, in case the user poses for putting the ball, grabbing the putter 23, the rotational, motional pendulum 27 of putting guide 25 rectilinearly moves in the forward and backward direction of the rectilinear guide 22, and the angular, motional pendulum 30 connected with both sides of rotational, motional pendulum 27 angularly moves in the forward and backward direction of the rectilinear guide 22. The vertical guides 33 and 33' move in the upward and downward direction of the angular, motional pendulum 30.

As described above, the invention has a construction that strikes the balls continuously and correctly through a rectilinear putting mechanism, such that the user can correct his putting posture, and develop his accurate, rectilinear putting sense.

It will be apparent to those skilled in the art that various modifications and variations can be made in the posture correction and stroke sense development apparatus for golf rectilinear putting practice mechanism of the present invention without departing from the spirit or scope of the invention. Thus, it is intended that the present invention cover the modifications and variations of this invention provided they come within the scope of the appended claims and their equivalents.

What is claimed is:

1. A golf rectilinear putting practice mechanism, comprising:

a rectangular frame having a base;

a mat mounted on the frame;

a hole used as a hole cup;

a rectilinear guide connected to brackets which are projecting from the base of the frame; and a putting guide located on the rectilinear guide to make a putter rectilinear, for providing a rise motion, a fall motion and a rotational motion in the forward and backward directions, the putting guide including:

a rotational pendulum received in the rectilinear guide for allowing the rectilinear guide to freely rotate about the shaft center of the rectilinear guide;

two angular pendulums connected to both sides of the rotational pendulum for allowing the rectilinear guide to freely perform an angular motion in the forward and backward direction;

two vertical guides respectively penetrating through the angular pendulums;

a putter guide attached at top end of the two vertical guides;

a putter club attached to the putter guide for holding the putter; and a detachment prevention bracket attached at the bottom of the two vertical guides, for the putter's rise and fall motions.

* * * * *